US007019235B2

(12) United States Patent
Wong et al.

(10) Patent No.: US 7,019,235 B2
(45) Date of Patent: Mar. 28, 2006

(54) PHOTOIMAGED CHANNEL PLATE FOR A SWITCH

(75) Inventors: Marvin Glenn Wong, Woodland Park, CO (US); John F. Casey, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 464 days.

(21) Appl. No.: 10/341,286

(22) Filed: Jan. 13, 2003

(65) Prior Publication Data

US 2004/0134763 A1 Jul. 15, 2004

(51) Int. Cl.
*H01H 29/00* (2006.01)

(52) U.S. Cl. ..... 200/182; 200/190; 200/192

(58) Field of Classification Search ..... 200/61.47, 200/220, 191, 192, 224, 197, 187–189, 199, 200/210, 214, 221, 222, 226–229, 235, 236, 200/182, 190; 427/79

See application file for complete search history.

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Von Tomkewitsch et al. |
| 3,529,268 | A | 9/1970 | Rauterberg |
| 3,600,537 | A | 8/1971 | Twyford |
| 3,639,165 | A | 2/1972 | Rairden |
| 3,657,647 | A | 4/1972 | Beusman et al. |
| 4,103,135 | A | 7/1978 | Gomez et al. |
| 4,200,779 | A | 4/1980 | Zakurdaev et al. |
| 4,238,748 | A | 12/1980 | Goullin et al. |
| 4,245,886 | A | 1/1981 | Kolodzey et al. |

(Continued)

FOREIGN PATENT DOCUMENTS

| | | |
|---|---|---|
| EP | 059.836 A1 | 10/1992 |
| FR | 2418539 | 9/1979 |
| FR | 2458138 | 12/1980 |
| FR | 2667396 | 4/1992 |
| JP | 62-276838 | 12/1987 |
| JP | 8-125487 | 5/1996 |
| JP | 63-294317 | 12/1998 |
| WO | WO 99/46624 | 9/1999 |

OTHER PUBLICATIONS

Marvin Glenn Wong, "Laser Cut Channel Plate for a Switch", patent application, 11 pages of specification, 5 pages of claims, 1 page of abstract, and 4 sheets of formal drawings (FIGS. 1–10).

Marvin Glenn Wong, "A Piezoelectrically Actuated Liquid Metal Switch", May 2, 2002, patent appication (pending), 12 pages of specification, 5 pages of claims, 1 page of abstract, and 10 sheets of drawings (FIGS. 1–10).

Jonathan Simon et al., "A Liquid–Filled Microrelay with a Moving Mercury Microdrop", Journal of Microelectromechanical Systems, vol. 6, No. 3, Sep. 1977, pp. 208–216.

Joonwon Kim et al., "A Micromechanical Switch with Electrostatically Driven Liquid–Metal Droplet", Sensors and Actuators, A:Physical. v 9798, Apr. 1, 2002, 4 pages.

(Continued)

*Primary Examiner*—Elvin Enad
*Assistant Examiner*—Lisa Klaus

(57) ABSTRACT

Disclosed herein is a channel plate for a fluid-based switch. The channel plate is produced by 1) depositing a photoimagable dielectric layer onto a substrate, 2) photoimaging at least one channel plate feature on the dielectric layer, and 3) developing the dielectric layer to form the at least one channel plate feature in the dielectric layer, thereby forming the channel plate. Switches using photoimaged channel plates, and a method for making a switch with a photoimaged channel plate, are also disclosed.

5 Claims, 6 Drawing Sheets

U.S. PATENT DOCUMENTS 4,336,570 A 6/1982 Brower et al.
4,419,650 A 12/1983 John
4,434,337 A 2/1984 Becker
4,475,033 A 10/1984 Willemsen et al.
4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,633,213 A 5/1997 Aghajanian et al.
5,644,676 A 7/1997 Blomberg et al.
5,677,823 A 10/1997 Smith
5,751,552 A 5/1998 Scanlan et al.
5,765,310 A 6/1998 Gold
5,828,799 A 10/1998 Donald
5,841,686 A 11/1998 Chu et al.
5,849,623 A 12/1998 Wojnarowski et al.
5,874,770 A 2/1999 Saia et al.
5,875,531 A * 3/1999 Nellissen et al. ..... 29/25.35
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 * 3/2001 Jiang ..... 427/333
6,212,308 B1 4/2001 Donald
6,225,133 B1 * 5/2001 Yamamichi et al. ..... 438/3
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,396,012 B1 5/2002 Bloomfield
6,396,371 B1 5/2002 Streeter et al.
6,408,112 B1 6/2002 Bartels
6,446,317 B1 * 9/2002 Figueroa et al. ..... 29/25.42
6,453,086 B1 9/2002 Tarazona
6,470,106 B1 10/2002 McClelland et al.
6,487,333 B1 11/2002 Fouquet et al.
6,501,354 B1 12/2002 Gutierrez et al.
6,516,504 B1 * 2/2003 Schaper ..... 29/25.42
6,559,420 B1 * 5/2003 Zarev ..... 219/209

OTHER PUBLICATIONS

Bhedwar, Homi C., et al., "Cermaic Multilayer Package Fabrication." Electronic Materials Handbook, Nov. 1989, pp. 460–469, vol. 1, Packaging, Sect. 4: Packages.
Simon, Jonathan, et al., "A Liquid Filled Microrelay with a Moving Mercury Microdrop." Journal of Microelectromechanical Systems, Sep. 1997, pp. 208–216, vol. 6, No. 3
US2002/0037128 A1, Mar. 28, 2002, Inv. Gerardus Johannes Burger, et al.
US2002/0146197 A1, Oct. 10, 2002, Inv. Yoon–Joong Yong.
US2002/0150323 A1, Oct. 17, 2002, Inv. Naoki Nishida, et al.
US2002/0168133 A1, Nov. 13, 2002, Takeshi Saito.
US2003/0035611 A1, Feb. 20, 2003, Youchun Shi.

* cited by examiner

PHOTOIMAGED CHANNEL PLATE FOR A SWITCH

BACKGROUND

Channel plates for liquid metal micro switches (LIMMS) can be made by sandblasting channels into glass plates, and then selectively metallizing regions of the channels to make them wettable by mercury or other liquid metals. One problem with the current state of the art, however, is that the feature tolerances of channels produced by sandblasting are sometimes unacceptable (e.g., variances in channel width on the order of ±20% are sometimes encountered). Such variances complicate the construction and assembly of switch components, and also place limits on a switch's size (i.e., there comes a point where the expected variance in a feature's size overtakes the size of the feature itself).

SUMMARY OF THE INVENTION

One aspect of the invention is embodied in a channel plate for a fluid-based switch. The channel plate is produced by 1) depositing a photoimagable dielectric layer onto a substrate, 2) photoimaging at least one channel plate feature on the dielectric layer, and 3) developing the dielectric layer to form the at least one channel plate feature in the dielectric layer, thereby forming the channel plate.

Another aspect of the invention is embodied in a switch comprising a photoimaged channel plate and a switching fluid. The photoimaged channel plate defines at least a portion of a number of cavities, a first of which is defined by a first channel formed in the photoimaged channel plate. The switching fluid is held within one or more of the cavities, and is movable between at least first and second switch states in response to forces that are applied to the switching fluid.

Other embodiments of the invention are also disclosed.

BRIEF DESCRIPTION OF THE DRAWINGS

Illustrative embodiments of the invention are illustrated in the drawings, in which.

DETAILED DESCRIPTION OF THE INVENTION

When sandblasting channels into a glass plate, there are limits on the feature tolerances of the channels. For example, when sandblasting a channel having a width measured in tenths of millimeters (using, for example, a ZERO automated blasting machine manufactured by Clemco Industries Corporation of Washington, Mo., USA), variances in channel width on the order of ±20% are sometimes encountered. Large variances in channel length and depth are also encountered. Such variances complicate the construction and assembly of liquid metal micro switch (LIMMS) components. For example, channel variations within and between glass channel plate wafers require the dispensing of precise, but varying, amounts of liquid metal for each channel plate. Channel feature variations also place a limit on the sizes of LIMMS (i.e., there comes a point where the expected variance in a feature's size overtakes the size of the feature itself).

In an attempt to remedy some or all of the above problems, photoimaged channel plates, and methods for making same, are disclosed herein. It should be noted, however, that the channel plates and methods disclosed may be suited to solving other problems, either now known or that will arise in the future.

Using the methods and apparatus disclosed herein, variances in channel width for channels measured in tenths of millimeters (or smaller) can be reduced to about ±3%.

Figure 1:
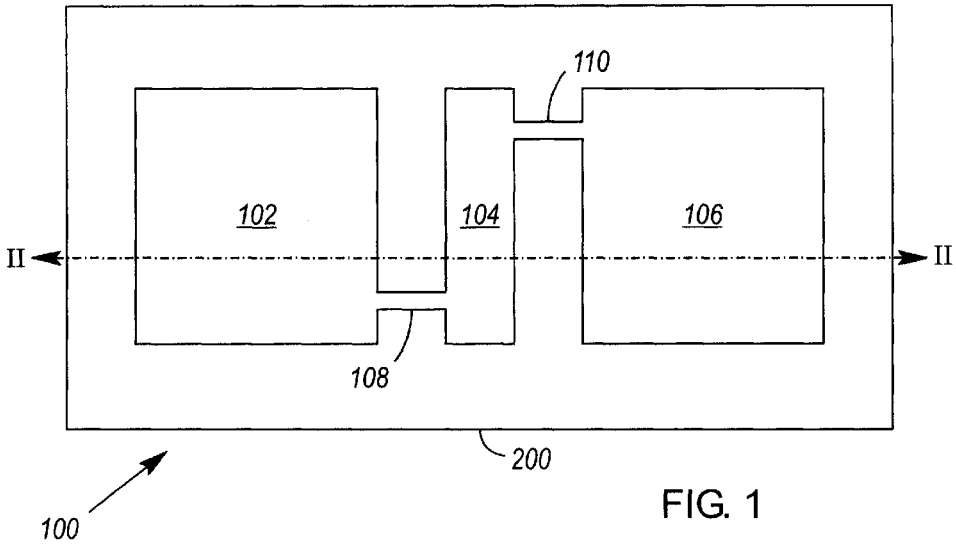
FIG. 1 illustrates an exemplary plan view of a photoimaged channel plate for a switch.
Figure 2:
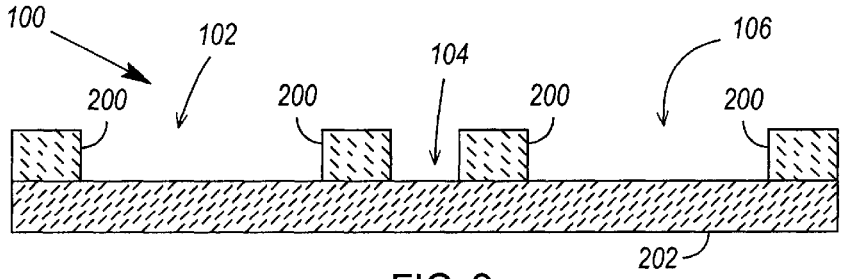
FIG. 2 illustrates an elevation view of the FIG. 1 channel plate.
Figure 3:
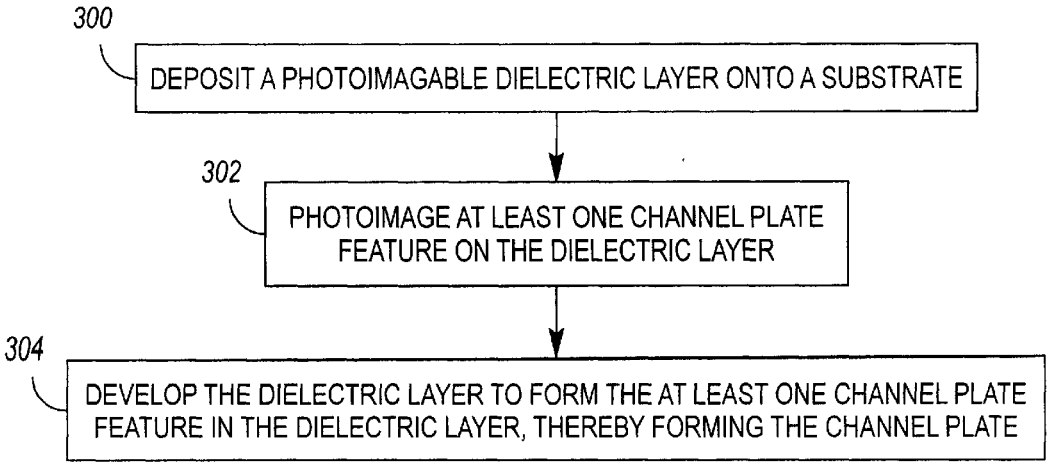
FIG. 3 illustrates a method for producing the FIG. 1 channel plate.

FIGS. 1 & 2 illustrate a first exemplary embodiment of a photoimaged channel plate 100 for a fluid-based switch such as a LIMMS. As illustrated in FIG. 3, the channel plate 100 may be produced by 1) depositing 300 a photoimagable dielectric layer 200 onto a substrate 202, 2) photoimaging 302 at least one channel plate feature 102, 104, 106, 108, 110 on the dielectric layer 200, and 3) developing 304 the dielectric layer 200 to form the at least one channel plate feature 102–110 in the dielectric layer 200, thereby forming the channel plate 100.

Figure 4:
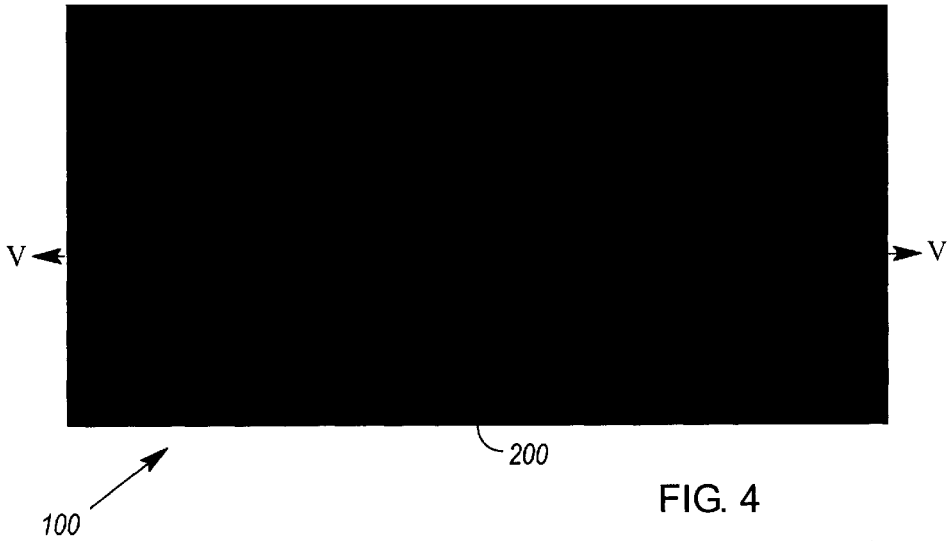
FIGS. 4 & 5 illustrate the deposition of a dielectric layer onto a substrate.
Figure 5:
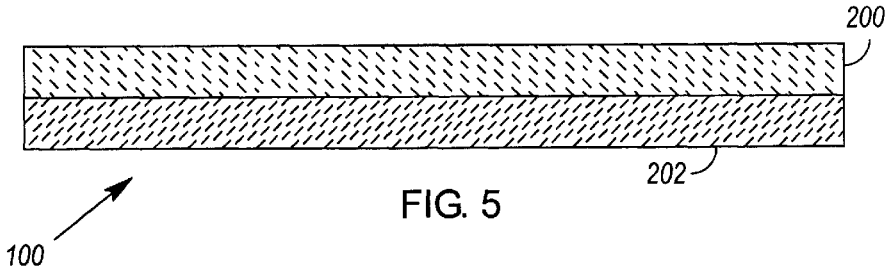
Figure 6:
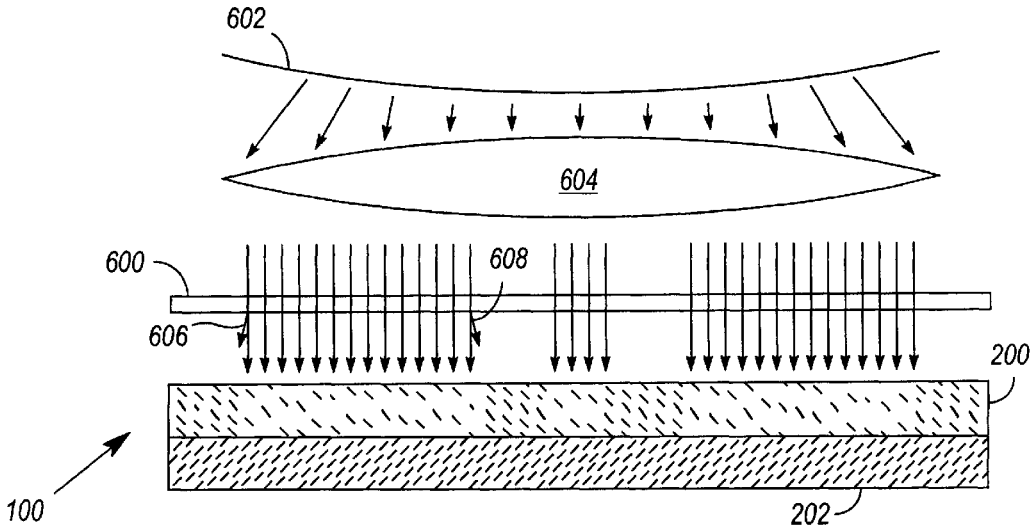
FIG. 6 illustrates the photoimaging of channel plate features on the dielectric layer shown in FIGS. 4 & 5.

The method illustrated in FIG. 3 is illustrated in more detail in FIGS. 4–6. As shown in FIGS. 4 & 5, a dielectric layer 200 is deposited onto a substrate 202. The substrate 202 may take a variety of forms and, in one embodiment, is an alumina ceramic. The dielectric layer 200 may also take a variety of forms, and need only be photoimagable. Examples of photoimagable dielectrics include glass, ceramic and polymer thick (or thin) films. In one embodiment, the dielectric layer 200 comprises DuPont® Fodel® dielectric material (manufactured by E. I. du Pont de Nemours and Company of Wilmington, Del., USA). In another embodiment, the dielectric layer 200 comprises Heraeus KQ dielectric material (manufactured by W. C. Heraeus GmbH & Co. of Hanau, Germany).

The dielectric layer 200 may be deposited onto the substrate 202 by means of screen printing, stencil printing, doctor blading, roller coating, dip coating, spin coating, hot roll laminating or electrophoresis, or by other means now known or to be developed. If desired (or if required by the type of dielectric), the dielectric layer 200 may then be dried. The dielectric layer 200 may also be ground to achieve a desired or more uniform thickness of the layer. In this manner, the depth of features 102–110 that are to be developed from the dielectric 200 can be precisely controlled. Although grinding may not be necessary when the depth of a dielectric layer 200 is substantially greater than the expected depth tolerance of a deposition process, grinding may be useful when the depth of a dielectric layer 200 and the expected depth tolerance of a deposition process are on the same order of magnitude.

Following the deposition of a dielectric layer 200 onto a substrate 202, and as shown in FIG. 6, one or more channel plate features 102–110 may be photoimaged on the layer 200. A variety of techniques are known for photoimaging. According to one technique, a mask 600 is placed on or above the dielectric layer 200, and a light source such as an ultraviolet (UV) or laser light source 602 is shone on the mask 600. Optionally, a lens 604 may be used to focus and/or collimate the rays from the light source 602. Without collimation, stray light rays can sometimes photoimage portions of a dielectric that a mask 600 is expected to cover (see, e.g., phantom arrows 606 and 608, which illustrate the possible directions of non-collimated light rays in the absence of lens 604).

According to another photoimaging technique (not shown), a photoresist may be applied to the dielectric layer 200. If a photoresist is used, the photoresist takes the place of mask 600 to control which portions of the dielectric 200 are exposed to a light source 602.

Following the photoimaging process illustrated in FIG. 6, the dielectric layer 200 is developed. The developing process may comprise, for example, flooding or washing the dielectric layer 200 with an organic solvent or aqueous developing solution. Those portions of the dielectric layer 200 that have been exposed to the light source 602 during photoimaging break down and wash away with the developing solution. Depending on the developing solution used, as well as the makeup of the dielectric layer 200, the dielectric layer 200 may need to be rinsed to prevent the developing solution from eating away portions of the dielectric layer 200 that have not been exposed to the light source 602. The end product of the developing process is a channel plate 100 with various features 102–110 formed therein (see FIGS. 1 & 2).

The above paragraphs describe a positive photoimaging process. However, a negative process could also be used. In a negative process, the portions of the dielectric layer which have not been exposed to the light break down and wash away with the developing solution. The chemistry is somewhat different, but the process is known in the industry.

If the dielectric layer 200 is a ceramic-based or glass-based dielectric, it may be necessary to fire the channel plate at a high temperature to cure and harden the dielectric layer 200. If the dielectric layer 200 is polymer-based, the layer may only need to be dried. Optionally, and depending on how precisely the depths of the layer's features 102–110 need to be controlled, the dielectric layer 200 may be ground to achieve a desired or more uniform thickness of the layer. Although pre-firing grinding is likely to be easier (as the dielectric layer 200 may be softer), there may be times when a post-firing grinding step is necessary and/or easier.

Figure 7:
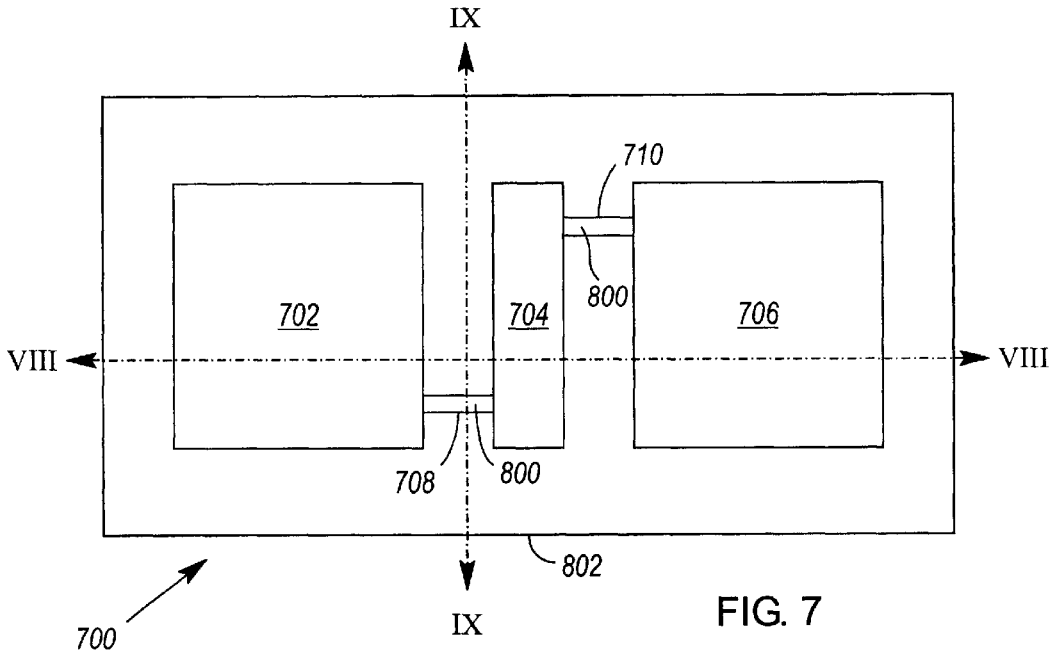
FIGS. 7–9 illustrate the photoimaging of different patterns of channel plate features in different dielectric layers.
Figure 8:
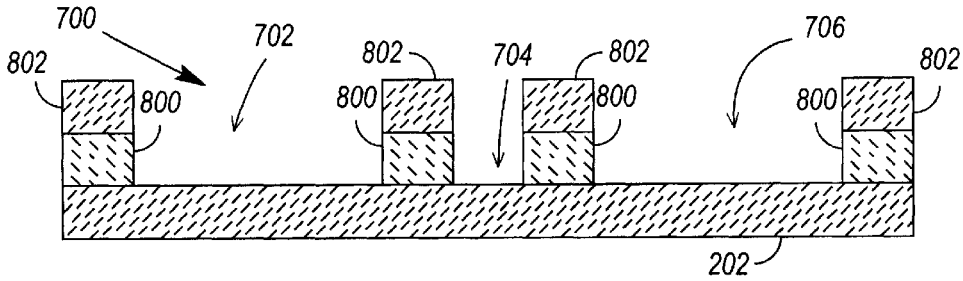
Figure 9:
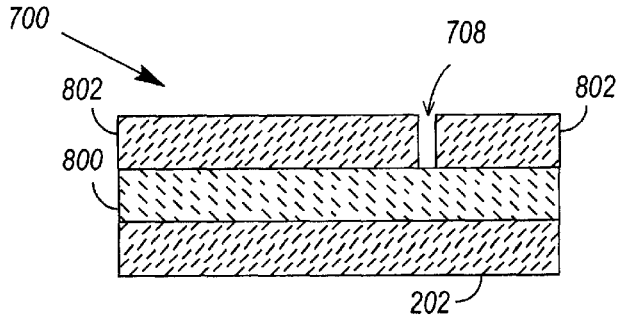

In FIGS. 1 & 2, all of the channel plate's features 102–110 are of the same depth. If channel plate features of varying depths are desired, it may be easier to form the features 702–710 in two or more dielectric layers 800, 802. To this end, FIGS. 7–9 illustrate a channel plate 700 comprising a plurality (i.e., two or more) of dielectric layers 800, 802. The first layer 800 is deposited onto a substrate 202, and a number of features 702–706 are formed therein, as already shown in FIGS. 1, 2 and 4–6. The second dielectric layer 802 is then deposited on top of the first layer 800, and the photoimaging and developing actions are repeated for the second layer. Additional dielectric layers can be deposited on top of the existing layers in the same manner.

In FIGS. 7–9, three deep channel plate features 702–706 are formed in the first and second dielectric layers 800, 802, and two shallow channel plate features 708, 710 are formed only in the second dielectric layer 802. However, one of ordinary skill in the art will recognize that the photoimaging of two different patterns of channel plate features in two different dielectric layers 800, 802 is only exemplary of the process for creating channel plate features of differing depths and, in practice, any number of patterns of channel plate features may be photoimaged in any number of dielectric layers. Likewise, if a feature is too deep to be photoimaged in one dielectric layer, the same feature may be photoimaged in successive dielectric layers.

Depending on the makeup of the existing dielectric layers 800, the existing layers 800 may heed to be fired prior to depositing a next layer 802 thereon. Otherwise, the pattern of channel plate features that is to be photoimaged on the new layer 802 might also photoimage into the existing layer 800.

In one exemplary embodiment of the invention (see, e.g., FIGS. 1 & 2), the features that are photoimaged in a channel plate 100 comprise a switching fluid channel 104, a pair of actuating fluid channels 102, 106, and a pair of channels 108, 110 that connect corresponding ones of the actuating fluid channels 102, 106 to the switching fluid channel 104 (NOTE: The usefulness of these features in the context of a switch will be discussed later in this description.). By way of example only, the switching fluid channel 104 may have a width of about 200 microns, a length of about 2600 microns, and a depth of about 200 microns; the actuating fluid channels 102, 106 may each have a width of about 350 microns, a length of about 1400 microns, and a depth of about 300 microns; and the channels 108, 110 that connect the actuating fluid channels 102, 106 to the switching fluid channel 104 may each have a width of about 100 microns, a length of about 600 microns, and a depth of about 130 microns.

It is envisioned that more or fewer channels may be formed in a channel plate, depending on the configuration of the switch in which the channel plate is to be used. For example, and as will become more clear after reading the following descriptions of various switches, the pair of actuating fluid channels 102, 106 and pair of connecting channels 108, 110 disclosed in the preceding paragraph may be replaced by a single actuating fluid channel and single connecting channel.

Figure 10:
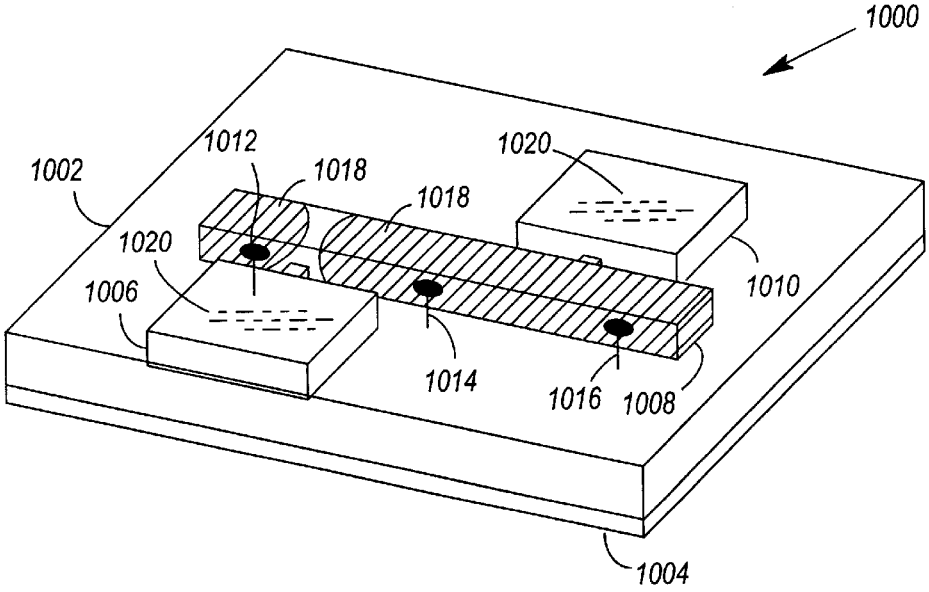
FIG. 10 illustrates a first exemplary embodiment of a switch having a photoimaged channel plate.

FIG. 10 illustrates a first exemplary embodiment of a switch 1000. The switch 1000 comprises a photoimaged channel plate 1002 defining at least a portion of a number of cavities 1006, 1008, 1010, a first cavity of which is defined by a first channel formed in the photoimaged channel plate 1002. The remaining portions of the cavities 1006–1010, if any, may be defined by a substrate 1004 to which the channel plate 1002 is sealed. Exposed within one or more of the cavities are a plurality of electrodes 1012, 1014, 1016. A switching fluid 1018 (e.g., a conductive liquid metal such as mercury) held within one or more of the cavities serves to open and close at least a pair of the plurality of electrodes 1012–1016 in response to forces that are applied to the switching fluid 1018. An actuating fluid 1020 (e.g., an inert gas or liquid) held within one or more of the cavities serves to apply the forces to the switching fluid 1018.

In one embodiment of the switch 1000, the forces applied to the switching fluid 1018 result from pressure changes in the actuating fluid 1020. The pressure changes in the actuating fluid 1020 impart pressure changes to the switching fluid 1018, and thereby cause the switching fluid 1018 to change form, move, part, etc. In FIG. 10, the pressure of the actuating fluid 1020 held in cavity 1006 applies a force to part the switching fluid 1018 as illustrated. In this state, the rightmost pair of electrodes 1014, 1016 of the switch 1000 are coupled to one another. If the pressure of the actuating fluid 1020 held in cavity 1006 is relieved, and the pressure of the actuating fluid 1020 held in cavity 1010 is increased, the switching fluid 1018 can be forced to part and merge so that electrodes 1014 and 1016 are decoupled and electrodes 1012 and 1014 are coupled.

By way of example, pressure changes in the actuating fluid 1020 may be achieved by means of heating the actuating fluid 1020, or by means of piezoelectric pumping. The former is described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference for all that it discloses. The latter is described in U.S. patent application Ser. No. 10/137,691 of Marvin Glenn Wong filed May 2, 2002 and entitled "A Piezoelectrically Actuated Liquid Metal Switch", which is also incorporated by reference for all that it discloses. Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity. In such an arrangement, a photoimaged channel plate could be constructed for the switch as disclosed herein.

The channel plate 1002 of the switch 1000 may comprise one or more dielectric layers with features photoimaged therein as illustrated in FIGS. 1 & 2, or as illustrated in FIGS. 7–9 (wherein different dielectric layers may comprise photoimaged channels defining different subsets of the switch's cavities 1006, 1008, 1010). In one embodiment of the switch 1000, the first channel in the channel plate 1002 defines at least a portion of the one or more cavities 1008 that hold the switching fluid 1018. A second channel (or channels) may be formed in the channel plate 1002 so as to define at least a portion of the one or more cavities 1006, 1010 that hold the actuating fluid 1020. A third channel (or channels) may be formed in the channel plate 1002 so as to define at least a portion of one or more cavities that connect the cavities 1006–1010 holding the switching and actuating fluids 1018, 1020.

Additional details concerning the construction and operation of a switch such as that which is illustrated in FIG. 10 may be found in the afore-mentioned patent of Kondoh et al. and patent application of Marvin Wong.

Figure 11:
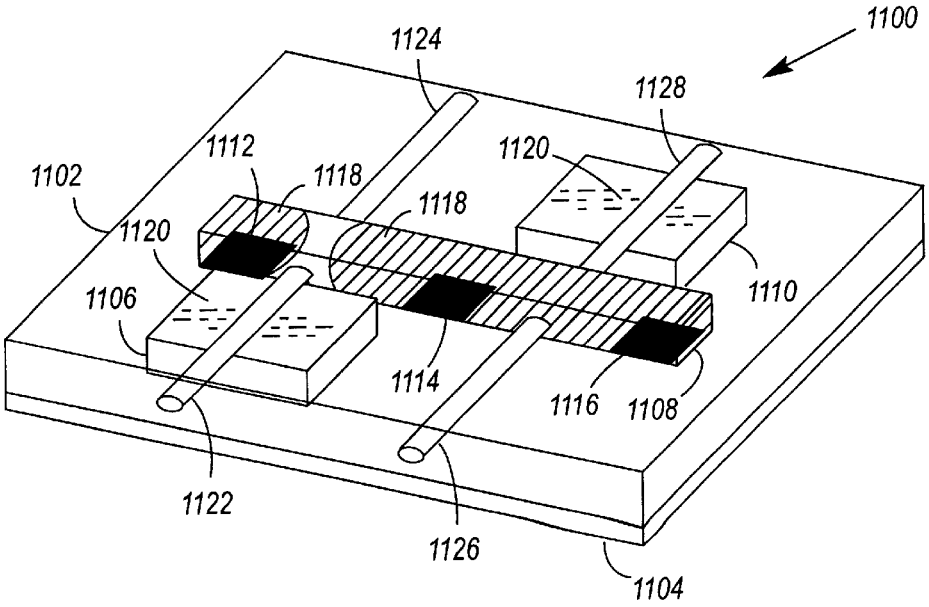
FIG. 11 illustrates a second exemplary embodiment of a switch having a photoimaged channel plate.

FIG. 11 illustrates a second exemplary embodiment of a switch 1100. The switch 1100 comprises a photoimaged channel plate 1102 defining at least a portion of a number of cavities 1106, 1108, 1110, a first cavity of which is defined by a, first channel formed in the photoimaged channel plate 1102. The remaining portions of the cavities 1106–1110, if any, may be defined by a substrate 1104 to which the channel plate 1102 is sealed. Exposed within one or more of the cavities are a plurality of wettable pads 1112–1116. A switching fluid 1118 (e.g., a liquid metal such as mercury) is wettable to the pads 1112–1116 and is held within one or more of the cavities. The switching fluid 1118 serves to open and block light paths 1122/1124, 1126/1128 through one or more of the cavities, in response to forces that are applied to the switching fluid 1118. By way of example, the light paths may be defined by waveguides 1122–1128 that are aligned with translucent windows in the cavity 1108 holding the switching fluid. Blocking of the light paths 1122/1124, 1126/1128 may be achieved by virtue of the switching fluid 1118 being opaque. An actuating fluid 1120 (e.g., an inert gas or liquid) held within one or more of the cavities serves to apply the forces to the switching fluid 1118.

Forces may be applied to the switching and actuating fluids 1118, 1120 in the same manner that they are applied to the switching and actuating fluids 1018, 1020 in FIG. 10.

The channel plate 1102 of the switch 1100 may comprise one or more dielectric layers with features photoimaged therein as illustrated in FIGS. 1 & 2, or as illustrated in FIGS. 7–9 (wherein different dielectric layers may comprise photoimaged channels defining different subsets of the switch's cavities 1106, 1108, 1110). In one embodiment of the switch 1100, the first channel in the channel plate 1102 defines at least a portion of the one or more cavities 1108 that hold the switching fluid 1118. A second channel (or channels) may be formed in the channel plate 1102 so as to define at least a portion of the one or more cavities 1106, 1110 that hold the actuating fluid 1120. A third channel (or channels) may be formed in the channel plate 1102 so as to define at least a portion of one or more cavities 1106–1110 that connect the cavities holding the switching and actuating fluids 1118, 1120.

Additional details concerning the construction and operation of a switch such as that which is illustrated in FIG. 11 may be found in the afore-mentioned patent of Kondoh et al. and patent application of Marvin Wong.

The types of channel plates 100, 700 and method for making same disclosed in FIGS. 1–9 are not limited to use with the switches 1000, 1100 disclosed in FIGS. 10 & 11 and may be used in conjunction with other forms of switches that comprise, for example, 1) a photoimaged channel plate defining at least a portion of a number of cavities, a first cavity of which is defined by a first channel formed in the photoimaged channel plate, and 2) a switching fluid, held within one or more of the cavities, that is movable between at least first and second switch states in response to forces that are applied to the switching fluid.

Figure 12:
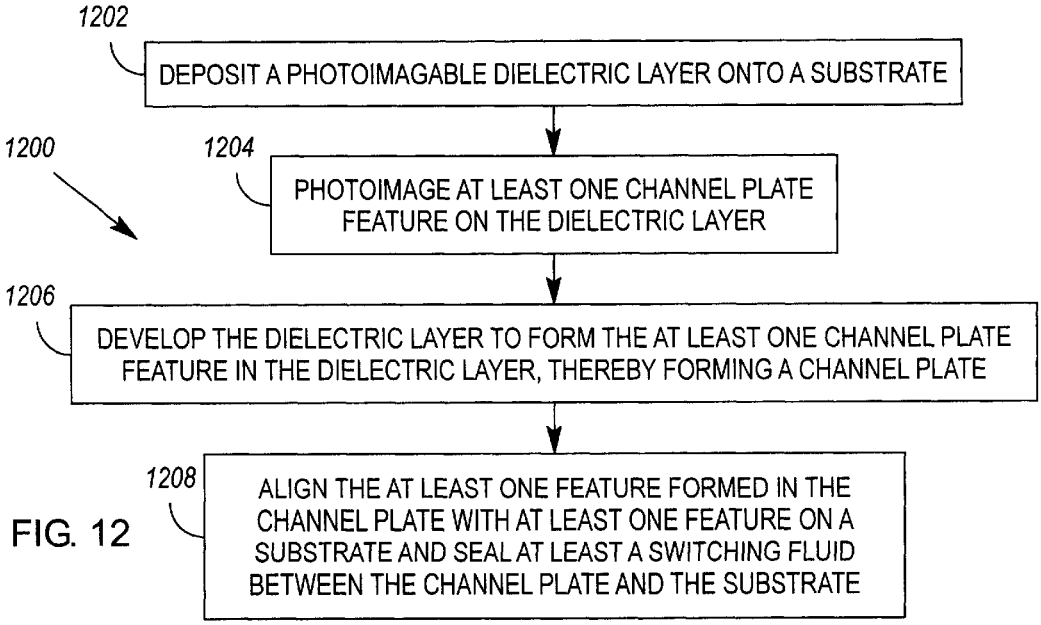
FIG. 12 illustrates an exemplary method for making a fluid-based switch.

An exemplary method 1200 for making a fluid-based switch is illustrated in FIG. 12. The method 1200 commences with the deposition 1202 of a photoimagable dielectric layer onto a substrate. At least one channel plate feature is then photoimaged 1204 on the dielectric layer. Thereafter, the dielectric layer is developed 1206 to form the at least one channel plate feature in the dielectric layer, thereby forming a channel plate. Optionally, portions of the channel plate may then be metallized (e.g., via sputtering or evaporating through a shadow mask, or via etching through a photoresist). Finally, features formed in the channel plate are aligned with features formed on a substrate, and at least a switching fluid (and possibly an actuating fluid) is sealed 1208 between the channel plate and a substrate.

Figure 13:
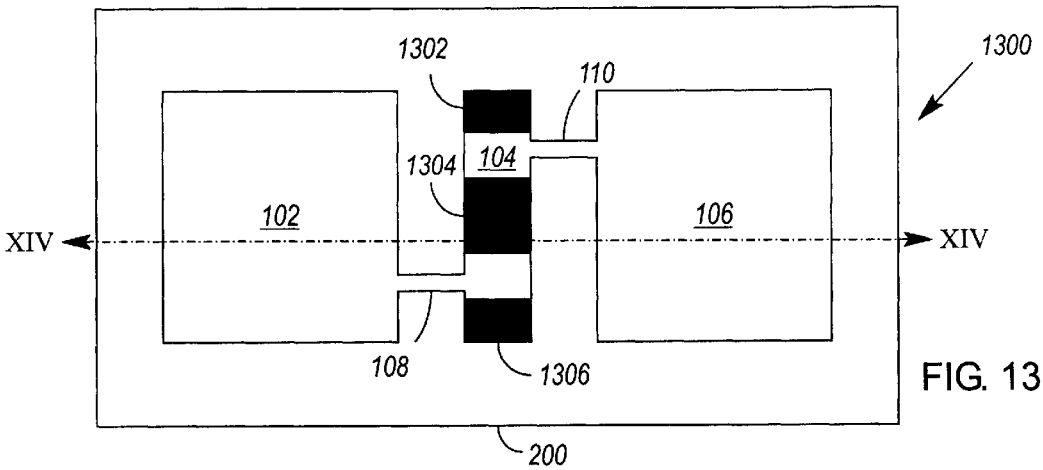
FIGS. 13 & 14 illustrate the metallization of portions of the FIG. 1 channel plate.
Figure 14:
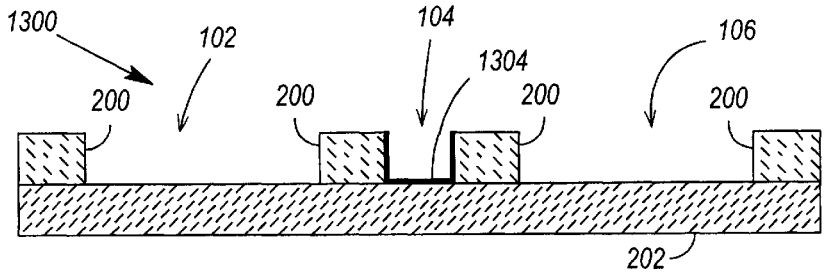

FIGS. 13 & 14 illustrate how portions of a channel plate 1300 similar to that which is illustrated in FIGS. 1 & 2 may be metallized for the purpose of creating "seal belts" 1302, 1304, 1306. The creation of seal belts 1302–1306 within a switching fluid channel 104 provides additional surface areas to which a switching fluid may wet. This not only helps in latching the various states that a switching fluid can assume, but also helps to create a sealed chamber from which the switching fluid cannot escape, and within which the switching fluid may be more easily pumped (i.e., during switch state changes).

Figure 15:
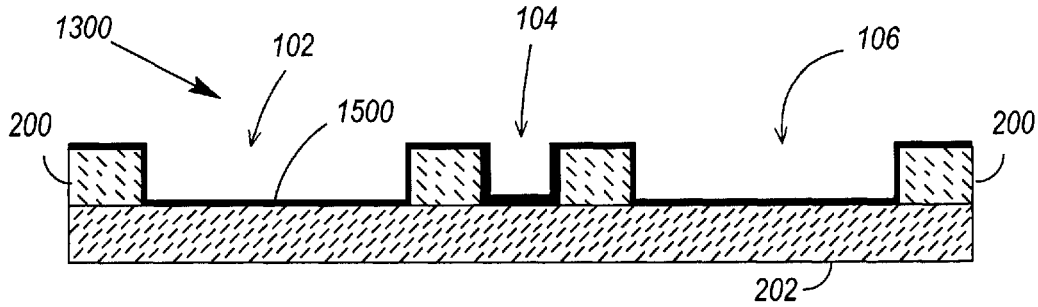
FIG. 15 illustrates the application of an adhesive to the FIG. 14 channel plate.
Figure 16:
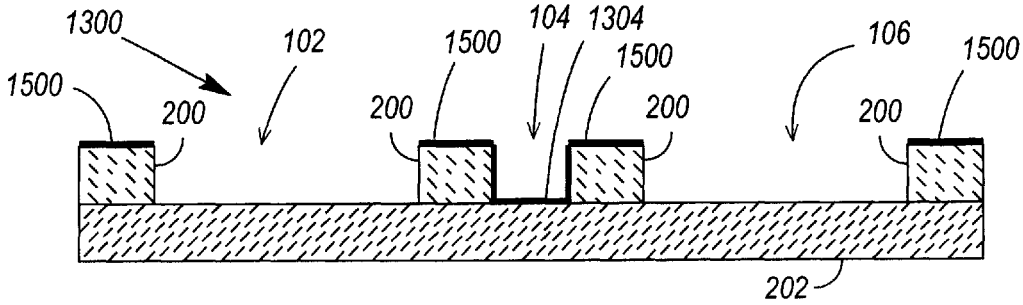
FIG. 16 illustrates the FIG. 15 channel plate after laser ablation of the adhesive from the plate's channels.

One way to seal a switching fluid between a channel plate and a substrate is by means of an adhesive 1500 applied to the channel plate. FIGS. 15 & 16 therefore illustrate how an adhesive 1500 (such as the Cytop™ adhesive manufactured by Asahi Glass Co., Ltd. of Tokyo, Japan) may be applied to the FIG. 14 channel plate 1300. The adhesive 1500 may be spin-coated or spray coated onto the channel plate 1300 and cured. Laser ablation may then be used to remove the adhesive from channels and/or other channel plate features (see FIG. 16).

Although FIGS. 13–16 disclose the creation of seal belts 1302–1306 on a channel plate 1300, followed by the application of an adhesive 1500 to the channel plate 1300, these processes could alternately be reversed.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A switch, comprising:

a) a photoimaged channel plate defining at least a portion of a number of cavities, a first cavity of which is defined by a first channel formed in the photoimaged channel plate;

b) a plurality of electrodes exposed within one or more of the cavities;

c) a switching fluid, held within one or more of the cavities, that serves to open and close at least a pair of the plurality of electrodes in response to forces that are applied to the switching fluid; and d) an actuating fluid, held within one or more of the cavities, that serves to apply said forces to the switching fluid.

2. The switch of claim 1, wherein the photoimaged channel plate comprises a plurality of dielectric layers, and wherein at least two of the dielectric layers comprise photoimaged channels defining different subsets of said number of cavities.

3. The switch of claim 1, wherein the first channel defines at least a portion of the one or more cavities that hold the switching fluid.

4. The switch of claim 3, wherein:

a) a second channel formed in the photoimaged channel plate defines at least a portion of the one or more cavities that hold the actuating fluid; and b) a third channel formed in the photoimaged channel plate defines at least a portion of one or more cavities that connect the cavities holding the switching and actuating fluids.

5. The switch of claim 1, wherein the channels formed in the photoimaged channel plate comprise a channel that defines at least a portion of the one or more cavities that hold the switching fluid, a pair of channels that define at least a portion of the one or more cavities that hold the actuating fluid, and a pair of channels connecting corresponding ones of the channels that hold the actuating fluid to the channel that holds the switching fluid.

* * * * *